US008763545B2

(12) United States Patent
Tseng

(10) Patent No.: US 8,763,545 B2
(45) Date of Patent: Jul. 1, 2014

(54) METHOD AND DEVICE FOR CONTROLLING SEWING PATTERNS OF A SEWING MACHINE

(76) Inventor: Hsien-Chang Tseng, Taichung (TW)

( * ) Notice: Subject to any disclaimer, the term of this patent is extended or adjusted under 35 U.S.C. 154(b) by 340 days.

(21) Appl. No.: 13/300,655

(22) Filed: Nov. 20, 2011

(65) Prior Publication Data

US 2013/0125803 A1 May 23, 2013

(51) Int. Cl.
*D05C 5/02* (2006.01)

(52) U.S. Cl.
USPC ..... 112/475.19; 112/454

(58) Field of Classification Search
USPC ..... 112/475.19, 475.1, 102.5, 454–457, 112/470.04, 470.06
See application file for complete search history.

(56) References Cited

U.S. PATENT DOCUMENTS

| | | | | | |
|---|---|---|---|---|---|
| 4,860,678 | A * | 8/1989 | Skogward | ..... | 112/470.04 |
| 5,791,270 | A * | 8/1998 | Mori | ..... | 112/102.5 |
| 5,911,182 | A * | 6/1999 | Uyama et al. | ..... | 112/102.5 |
| 5,924,372 | A * | 7/1999 | Okuda et al. | ..... | 112/102.5 |
| 6,032,595 | A * | 3/2000 | Okuyama | ..... | 112/102.5 |
| 6,131,526 | A * | 10/2000 | Iida et al. | ..... | 112/102.5 |
| 6,321,670 | B1 * | 11/2001 | Tomita et al. | ..... | 112/475.19 |

* cited by examiner

*Primary Examiner* — Danny Worrell
(74) *Attorney, Agent, or Firm* — Banger Shia

(57) ABSTRACT

A method and device for controlling sewing patterns of a sewing machine allows the user to edit the patterns or pattern strings saved in the database, and to mirror the patterns, or control the respective data of sewing. The sewing pattern can be easily and freely edited, and the information of all the sewing operations is clearly displayed on the display.

26 Claims, 12 Drawing Sheets

METHOD AND DEVICE FOR CONTROLLING SEWING PATTERNS OF A SEWING MACHINE

BACKGROUND OF THE INVENTION

1. Field of the Invention

The present invention relates to sewing machine, and more particularly to a method and device for controlling sewing patterns of a sewing machine 2. Description of the Prior Art Sewing and embroidering the embodiment of the beauty of orient art. In the old days, sewing and embroidering were manually made, and then semi-automatic sewing machine was invented. Nowadays, we have electronically controlled automatic sewing machines. However, the application of the electronically controlled automatic sewing machines is limited due to the fact that many of the electronically controlled sewing machines have limited choices of functions, or the control interface is inconvenient to use.

The present invention has arisen to mitigate and/or obviate the afore-described disadvantages.

SUMMARY OF THE INVENTION

The primary object of the present invention is to provide a method and device for controlling sewing patterns of a sewing machine, which is provided with various pattern editing functions to better satisfy user's various demands.

To achieve the above object, a device for controlling sewing patterns of a sewing machine comprising the following components:

The sewing machine is electrically connected to a power source and provided on its lateral surface with an ON/OFF button.

A control center is disposed inside the sewing machine and provided with a database and being connected to the ON/OFF button, pressing the ON/OFF button sends an instruction to the control center to stop or start sewing.

A control unit is electrically connected to the control center and disposed on an outer surface of the sewing machine, the control unit includes a display and an input device which are electrically connected to the control center, the input device includes a function selecting area and a quick operation area, the function selecting area includes at least one pattern mode selecting button, when the pattern mode selecting button is actuated, it will send instruction to the control center, a mode area and a pattern area will be displayed in the respective interfaces, so that the user is able to select the pattern mode that the pattern to be sewed belongs to, and to edit a single pattern mode or pattern string that is saved in the database of the control center.

The quick operation area includes a set of quick and digit buttons, the quick and digit buttons include a plurality of digit number buttons, after the pattern mode selecting button is pressed, the user input pattern number by pressing the digit number buttons in the sewing pattern selecting interface, so that corresponding patterns will be shown in the sewing pattern selecting interface for the user to select, a plurality of quick patterns is disposed beside the respective digit number buttons, so that pressing the digit number button is pressed, the sewing of a corresponding quick pattern will be performed.

A method for controlling sewing patterns of a sewing machine used in cooperation with the device for controlling sewing patterns of a sewing machine, comprises the following steps:

step of pattern selecting includes:

A selecting mode: pressing the pattern mode selecting button to select the pattern mode that the pattern to be sewed belongs to, and a select interface will be displayed on the display of the control unit and comprises: a mode area, a presser foot area, a sewing width area, a stitch length area, a pattern area and a thread pressure area; the mode area shows the present mode, and to change the mode, a user can press the pattern mode selecting button again; the presser foot area shows the type of the proposed pressure foot and the proposed pressure value; the sewing width area shows a value of sewing width; the stitch length area shows a value of stitch length; the pattern area shows the currently selected pattern and its corresponding pattern number; the thread pressure area shows a pressure of the sewing thread.

A selecting submode for selecting the pattern to be sewed, the mode selecting interface is displayed on a display to show the mode area and the pattern number of the pattern, and the user can move the cursor to change the pattern by changing the pattern number;

Confirming selected pattern: if the pattern is confirmed, the user should press the input and enter button, and if the pattern needs to be changed, the user should input a new pattern number and confirm again;

Pattern information displaying: when editing the pattern for the first time, and after the pattern is confirmed for the firs time, a single sewing pattern environment displaying interface for showing standard proposed information of the pattern will be displayed on the display, including a mode area, a presser foot area, a sewing width area, a stitch length area, a times of extension area, a number of repeat area, a pattern area, a single/double needle area, and an automatic stop area, the user can continue to select pattern numbers to form pattern string.

After the user's confirmation, a pattern string editing displaying interface will be displayed to show the selected pattern, the times of extension area, the number of repeat area, the pattern area, the single/double needle area, the automatic stop area, and a total length of the string of to be sewed patterns area, if want to add a pattern string, the user can press the digit number buttons, after confirmation, the pattern string will be added at the position wherein the cursor is located, if want to further edit the information settings and conditions of the pattern to be sewed, the user can move the cursor to the pattern and press the input and enter button to enter the single sewing pattern environment displaying interface, and then confirms the conditions and information settings displayed, if want to further adjust, the user can re-press the input and enter button to enter the database, so that, at the bottom of the display, the user can press the pattern-extension and memory reading button, the digit number button, the width adjustment buttons or the input and enter button to adjust the value of settings, then the user can press the ON/OFF button to perform the sewing operation or press the input and enter button to return to the pattern string editing displaying interface to continue to edit the pattern string, and then can press the ON/OFF button again to start sewing.

Step of sewing: after selecting the pattern, the user can press the ON/OFF button on the sewing machine to start sewing.

Step of sewing ending: pressing the ON/OFF button to stop the sewing.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
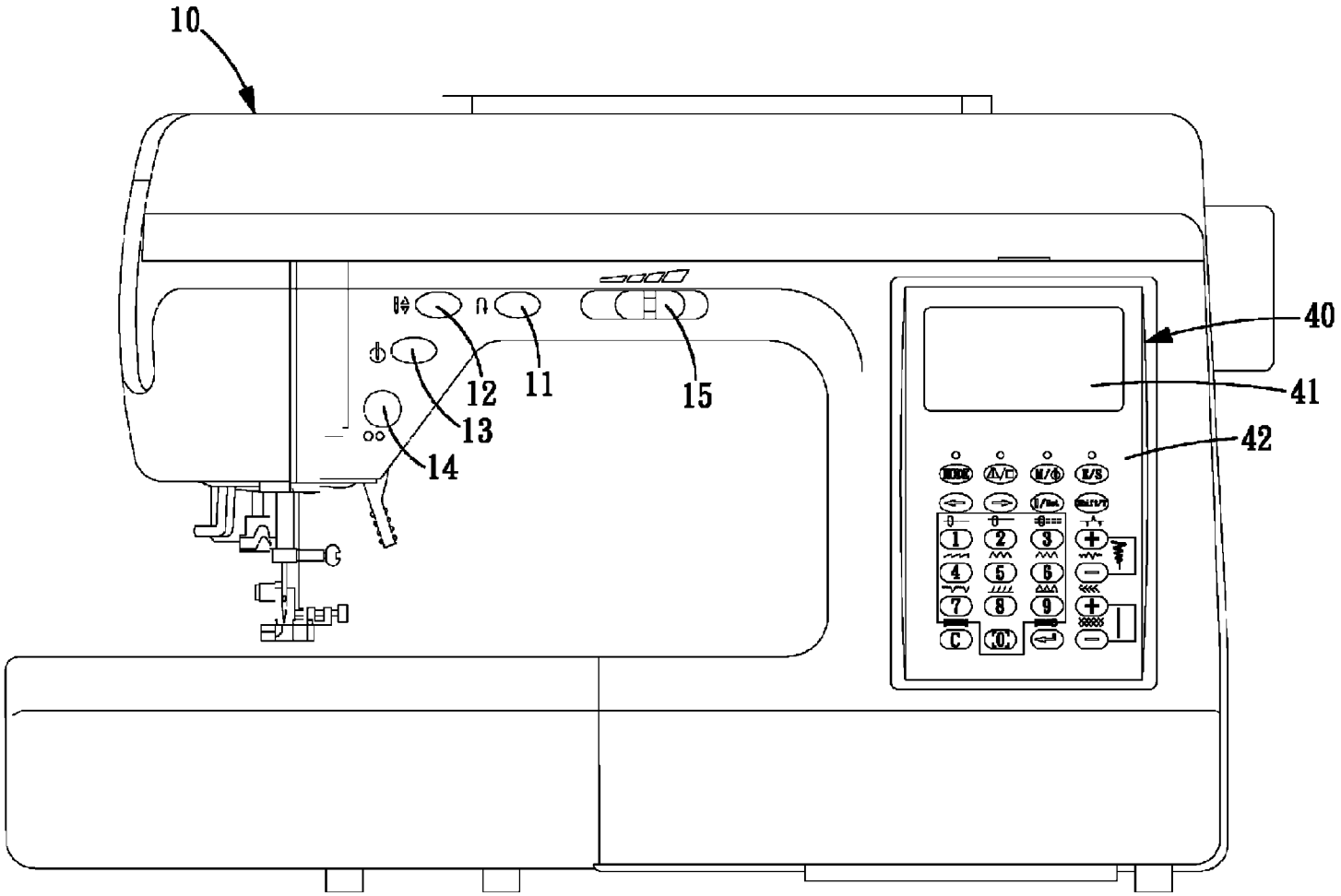
FIG. 1 shows a device for controlling sewing patterns of a sewing machine in accordance with a preferred embodiment of the present invention.
Figure 2:
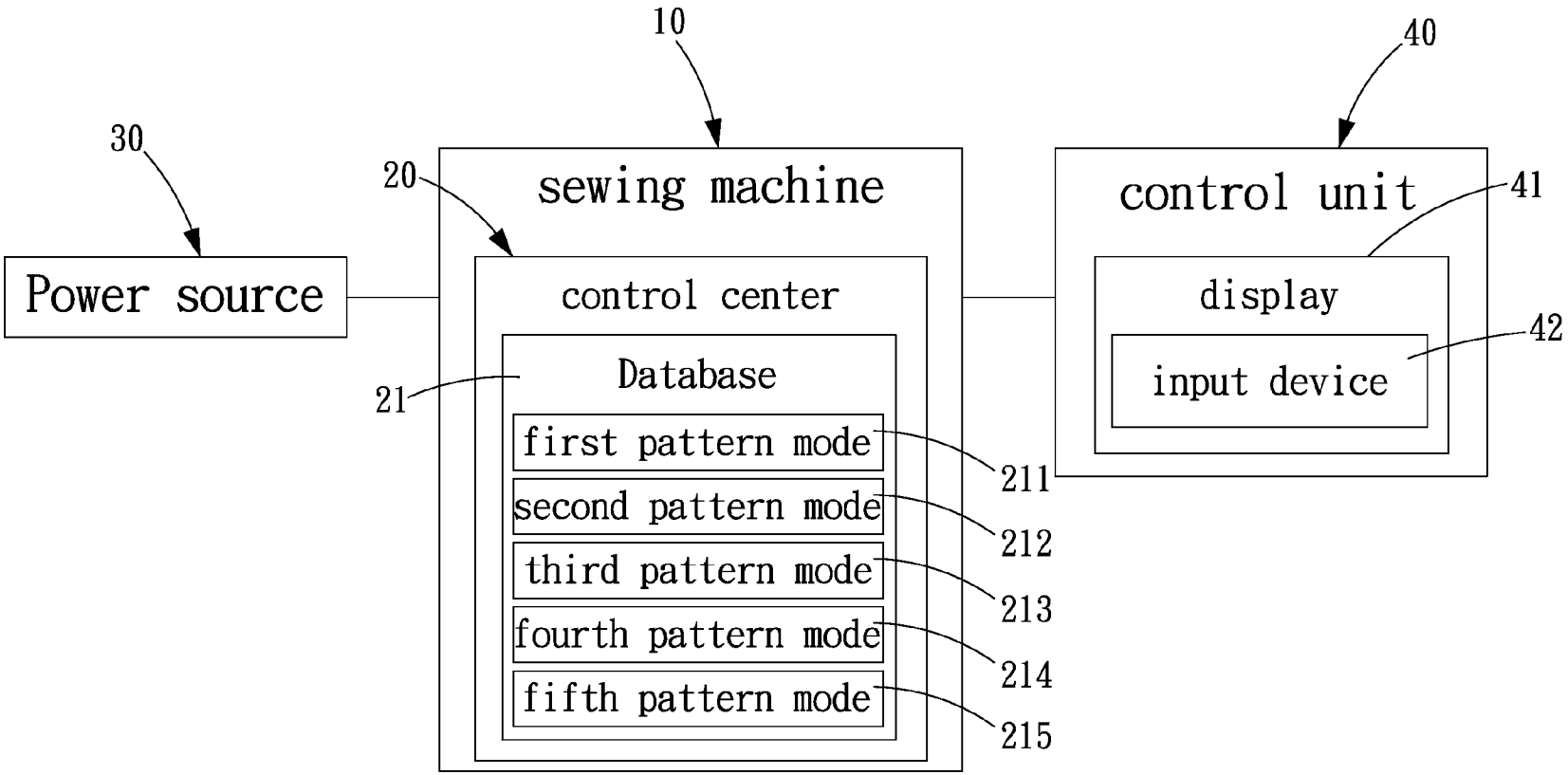
FIG. 2 is a systematic diagram showing the device for controlling sewing patterns of a sewing machine in accordance with the present invention.
Figure 3:
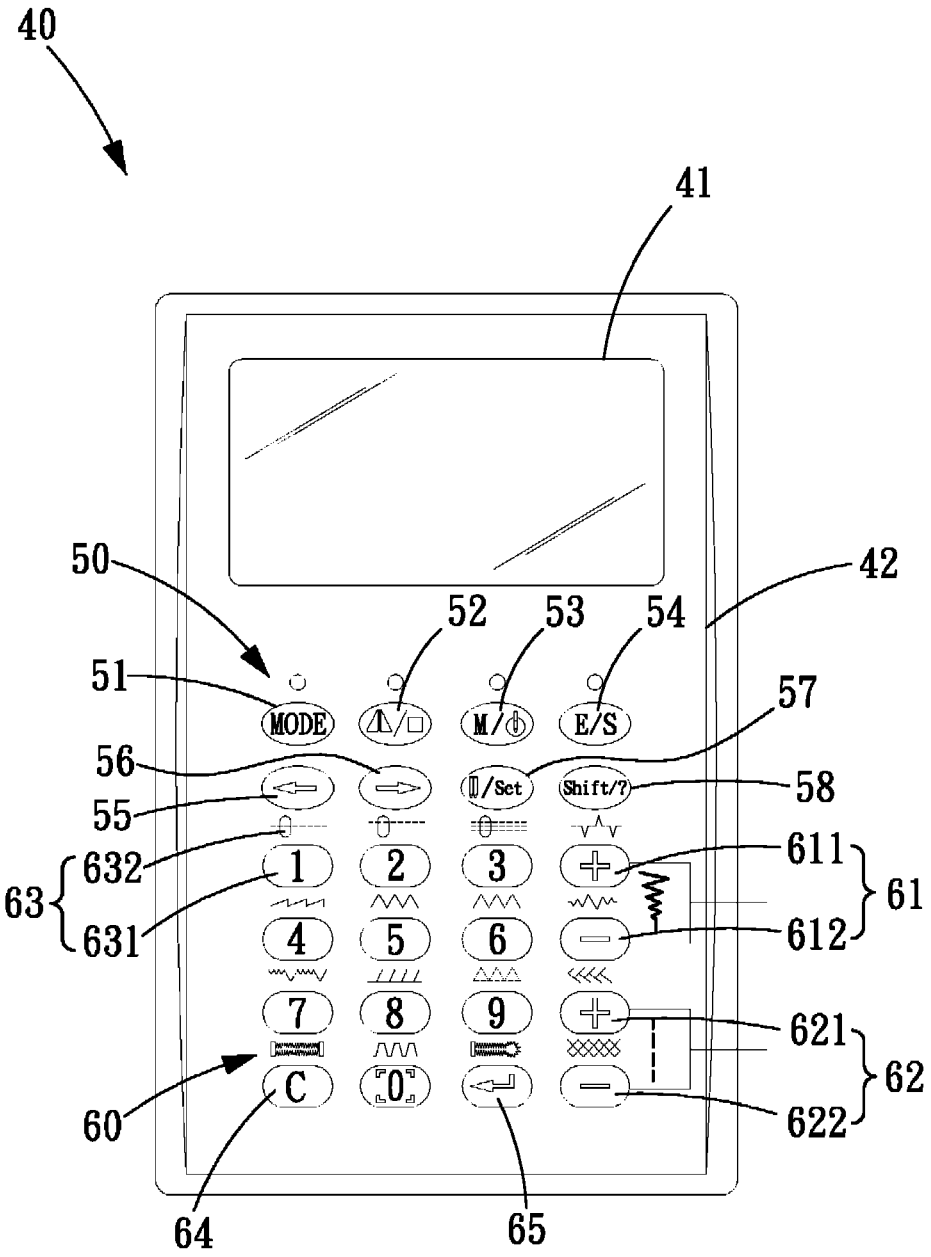
FIG. 3 shows the control unit of the device for controlling sewing patterns of a sewing machine in accordance with the present invention.

Referring to FIGS. 1-3, a device for controlling sewing patterns of a sewing machine in accordance with a preferred embodiment of the present invention comprises the following components.

A sewing machine 10 is provided on its lateral surface with a reverse sewing button 11, a needle-position adjustment button 12, a whipstitch button 13, an ON/OFF button 14, and a sewing speed control button 15.

A control center 20 is disposed inside the sewing machine 10 and provided with a database 21, and is connected to the reverse sewing button 11, the needle-position adjustment button 12, the whipstitch button 13, the ON/OFF button 14, and the sewing speed control button 15, respectively.

When sewing a specific pattern, the reverse sewing button 11 is used to transmit instruction to the control center 20, determining whether reverse sewing can be performed or not, if yes, then the control center 20 instructs to perform reverse sewing, if no, sewing stops. When the needle-position adjustment button 12 is actuated, it will send instruction to the control center 20, the control center 20 will lower the needle when finding that the needle stops in the high position, and vice versa, when finding that the needle stops in a lower position, the control center 20 will instruct the needle to move up.

When the whipstitch button 13 is actuated, it will send instruction to the control center 20, under the control of the control center 20, whipstitching will be performed after sewing pattern is finished.

When the ON/OFF button 14 is actuated, it will send instruction to the control center 20, and then the control center 20 will start or stop the sewing operation.

Adjusting the position of the sewing speed control button 15 can adjust sewing speed.

In the database 21 of the control center 20 is saved a plurality of pattern modes, including a first pattern mode 211, a second pattern mode 212, a third pattern mode 213, a fourth pattern mode 214 and a fifth pattern mode 215. The first pattern mode 211 includes a plurality of standard patterns, the second pattern mode 212 includes a plurality of basic patterns, the third pattern mode 213 includes a plurality of animals and plants, the fourth pattern mode 214 includes a plurality of other patterns, and the fifth pattern mode 215 includes a plurality of patterns of digital numbers.

A power source 30 is electrically connected to the sewing machine 10.

A control unit 40 is electrically connected to the control center 20 and disposed on the outer surface of the sewing machine 10. The control unit 40 includes a display 41 and an input device 42 which are electrically connected to the control center 20. The input device 42 further comprises a function selecting area 50 and a quick operation area 60.

The display 41 selectively displays the following interfaces: a mode selecting interface 411, a sewing pattern selecting interface 412, a sewing pattern displaying interface 413, a single sewing pattern environment displaying interface 414, and a pattern string editing displaying interface 415.

The mode selecting interface 411 is to display pattern mode and relative conditions of the displayed pattern.

The sewing pattern selecting interface 412 is provided with pattern mode and the pattern serial number corresponding to the pattern mode, so as to allow the user to select pattern in the sewing pattern selecting interface 412.

The sewing pattern displaying interface 413 is used to display the pattern corresponding to the pattern serial number selected by the user.

The single sewing pattern environment displaying interface 414 is used to display respective external conditions corresponding to the pattern selected by the user.

The pattern string editing displaying interface 415 is used to display a string of several patterns and the respective conditions and information of the patterns.

The function selecting area 50 includes a pattern mode selecting button 51, a mirror and automatic stop button 52, a memory and whipstitch button 53, a pattern-extension and memory reading button 54, a leftward and upward moving button 55, a rightward and downward moving button 56, a single/double needle selecting and setting button 57, and a Shift and help button 58. Above each of the pattern mode selecting button 51, the mirror and automatic stop button 52, the memory and whipstitch button 53, and the pattern-extension and memory reading button 54 is disposed a signal lamp.

When the pattern mode selecting button 51 is actuated, it will send instruction to the control center 20, so that the user can select the pattern mode that the pattern to be sewed belongs to, and the pattern mode is saved in the database 21 of the control center 20. A short press of the pattern mode selecting button 51 can perform a single pattern editing and sewing, and a long press of the pattern mode selecting button 51 can perform a string of patterns editing, at this moment, the signal lamp lights up, and a re-press of the pattern mode selecting button 51 can bring back the single pattern sewing, and the signal lamp lights out. It is to be noted that when a button is actuated" means that the button is pressed, namely the action of pressing the button. A short (a press that lasts for a predetermined length of time) press means to send out the instruction originally defined by button, and a long press (or a press that last over the predetermined length of time) can send out another instruction to the control center 20. Alternatively, instruction can be sent by other alternative ways, such as two or three times of short press within a predetermined length of time can also send out another instruction different from the original instruction of the button.

A short press of the mirror and automatic stop button 52 can send instruction to the control center 20, and then the pattern that can be mirrored is mirrored under the control of the control center 20. A long press of the mirror and automatic stop button 52 can send instruction to the control center 20, to allow the user to insert the stop element at the position where the sewing needs to stop, so that the control center 20 will control the sewing to stop at the position where the stop element is inserted, so as to prevent residual pattern. A short press of the mirror and automatic stop button 52 before inputting pattern can mirror all the patterns to be input in the future. A long press of the mirror and automatic stop button 52 before inputting pattern can pre-input the sewing length as desired and prompt when editing.

A short press of the memory and whipstitch button 53 can send instruction to the control center 20, and the control center 20 will save the edited string of patterns in the database 21 for future use. A long press of the memory and whipstitch button 53 can send instruction to the control center 20 to allow the user to insert the whipstitch sign in the position that needs to be whipstitched, so that under the control of the control center 20, whipsticthing will be carried out when the sewing moves to the position where the whipstitch signed is inserted, so as to prevent residual pattern. Whipstitching means to sew two or three times repeatedly at the original position to prevent unravelling.

A short press of the pattern-extension and memory reading button 54 can send instruction to the control center 20, and the control center 20 will control the pattern extension. A long press of the pattern-extension and memory reading button 54 can send instruction to the control center 20, and the control center 20 controls and reads the saved string of patterns.

Pressing the leftward and upward moving button 55 can send instruction to the control center 20, and then the control center 20 controls the cursor X on the display 41 of the control unit 40 to move leftward and upward.

Pressing the rightward and downward moving button 56 can send instruction to the control center 20, and then the control center 20 controls the cursor X on the display 41 of the control unit 40 to move rightward and downward.

Moving the cursor to the pattern to be sewed and pressing the leftward and upward moving button 55 the rightward and downward moving button 56 can send instruction to the control center 20, and then the control center 20 will control the sewing to start from the pattern in which the cursor is located.

A short press of the single/double needle selecting and setting button 57 can send instruction to the control center 20, and the control center 20 will sewing modes between single needle and double needle. A long press of the single/double needle selecting and setting button 57 can send instruction to the control center 20, and the control center 20 will start the basic function settings.

Pressing the Shift and help button 58 can activate the Shift "function", and then pressing the button of the quick operation area 60 of the input device 42 of the control unit 40 (after pressing the Shift and help button 58) can start to sew the pattern predetermined by this button of the quick operation area 60. Then pressing the pattern mode selecting button 51 can do "cross modes" editing. Then pressing the delete and exit button 64 can release (deactivate) the Shift function. A long press of the Shift and help button 58 can send instruction to the control center 20, and the control center 20 will start (activate) the explanation mode.

A short press of the Shift and help button 58 along with a long press of the mirror and automatic stop button 52 can send out a single-pattern-stop message, so that at each time when the sewing of the each one of the string of the patterns is finished, the sewing will stop automatically. A one more short press of the Shift and help button 58 along with a long press of the mirror and automatic stop button 52 can switch the sewing to normal sewing state. Furthermore, a short press of the Shift and help button 58 along with the memory and whipstitch button 53 can perform automatic whipstitching of a single pattern of the pattern string, namely performing the whipstitching of a single pattern of the pattern string prior to the sewing of the same, and the whipstiching should be performed one more time after the sewing is finished. A one more short press of the Shift and help button 58 along with a long press of the memory and whipstitch button 53 can switch the sewing to normal sewing state.

The quick operation area 60 includes a set of width adjustment buttons 61, a set of stitch length buttons 62, a set of quick and digit buttons 63, a delete and exit button 64 and an input and enter button 65.

The width adjustment buttons 61 include an increase button 611 and a decrease button 612. Pressing the increase button 611 can send an instruction to the control center 20 to increase the sewing width, similarly, pressing the decrease button 612 can send an instruction to the control center 20 to reduce the sewing width, and simultaneously pressing the increase and decrease buttons 611, 612 can return the sewing width back to default value.

The stitch length buttons 62 include an increase button 621 and a decrease button 622. Pressing the increase button 621 can send an instruction to the control center 20 to increase the stitch length, similarly, pressing the decrease button 622 can send an instruction to the control center 20 to reduce the stitch length, and simultaneously pressing the increase and decrease buttons 621, 622 can return the stitch length back to a default value. The quick and digit buttons 63 include a plurality of digit number buttons 631. A plurality of quick patterns 632 is disposed beside the respective digit number buttons 631, so that when the digit number button 631 is pressed, the sewing of a corresponding quick pattern 632 will be performed. To insert a pattern into the pattern string which is being sewed, the user can press the Shift and help button 58 and the quick and digit buttons 63 simultaneously to select a pattern designated by the buttons, and then the sewing of the selected pattern is performed, and after the sewing is finished, the user can press the delete and exit button 64 to switch back to the default sewing window to go on the sewing as long as not exiting from the pattern string which is being edited. Furthermore, anyone of the digit number buttons 631 can represent non-sewing instruction, such as the "digit number button 0" as shown in FIG. 3.

A short press of the delete and exit button 64 can make ready to delete an unwanted pattern in the editing of the pattern string, and a long press of the delete and exit button 64 can delete the unwanted pattern, which is accompanied by sending out a long audible warning. When in the "explanation mode", pressing the delete and exit button 64 can return back to previous menu (window), and pressing the delete and exit button 64 in the course of reading the memory can delete the memory content represented by the selected number.

During the course of editing, pressing the input and enter button 65 can confirm the information displayed on the display so as to be ready to perform the next operation. For example, pressing the pattern number can display the pattern designated by the selected numbers, if confirmed, pressing the input and enter button 65 can input the selected pattern into the pattern string. When in the "explanation mode", pressing the input and enter button 65 can enter the selected explanation mode.

Figure 4:
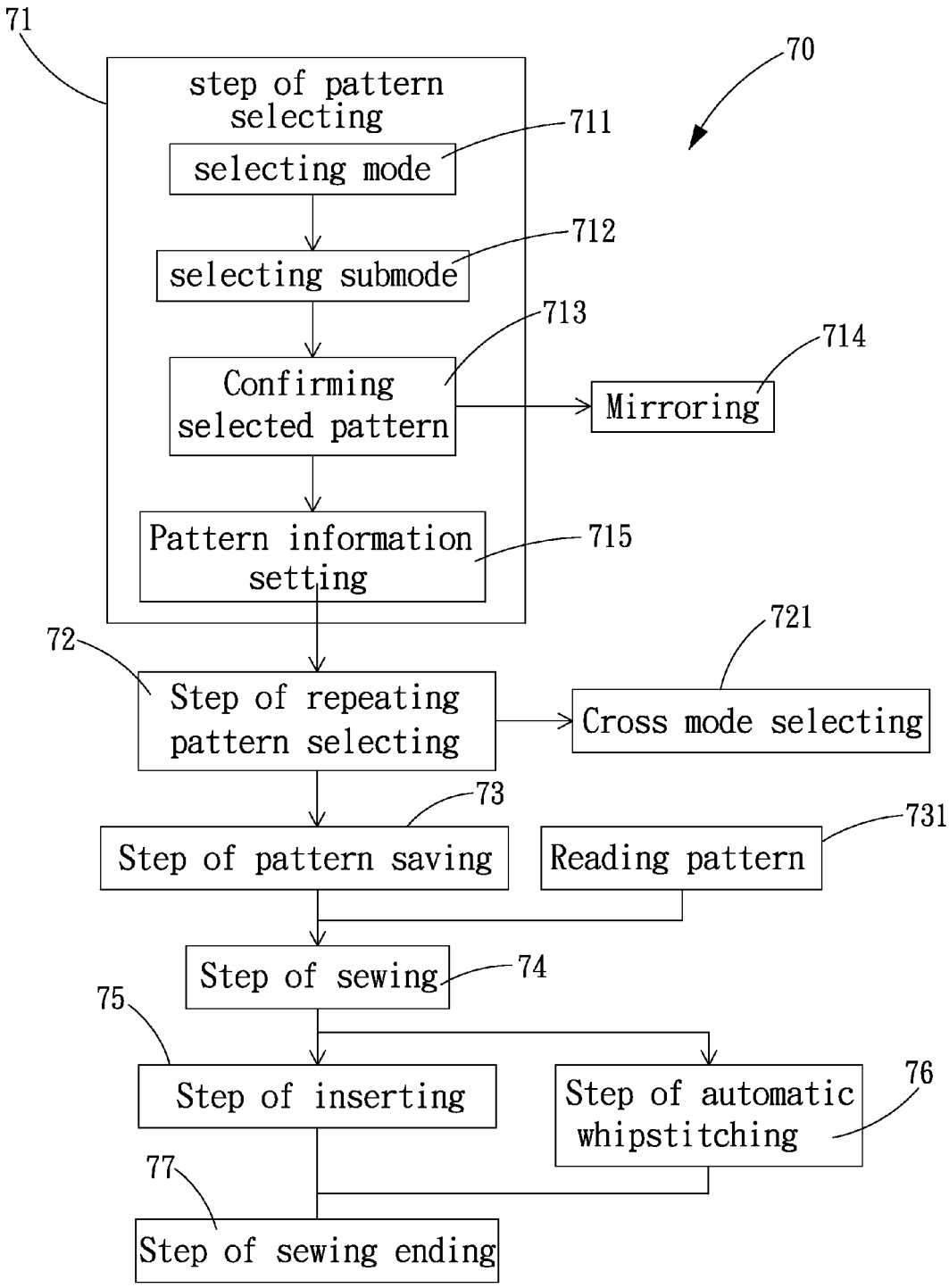
FIG. 4 is a flow chart showing a method for controlling sewing patterns of a sewing machine in accordance with the present invention.
Figure 5:
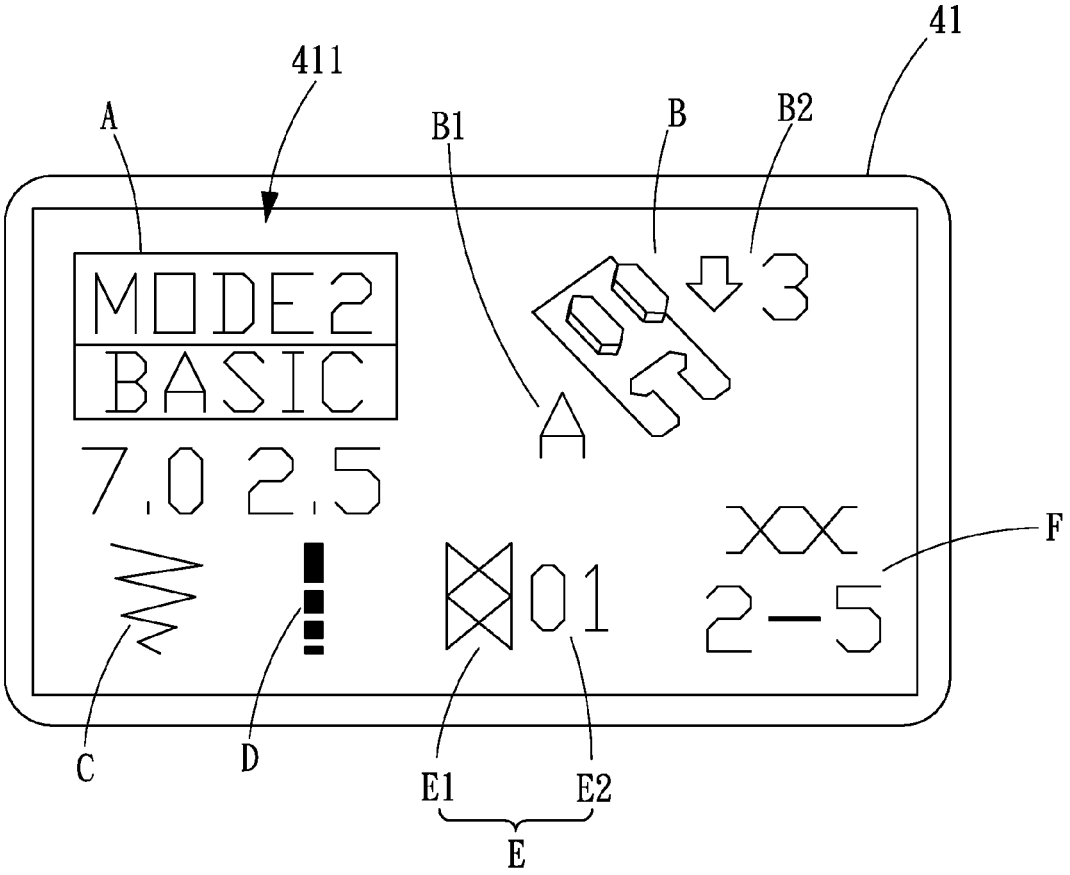
FIG. 5 shows a display of the device for controlling sewing patterns of a sewing machine in accordance with the present invention, wherein the step of mode selecting is displayed.

A method 70 for controlling sewing patterns of a sewing machine in accordance with the present invention comprises the following steps (as shown in FIG. 4):

Step of pattern selecting 71 includes:

Selecting mode 711: pressing the pattern mode selecting button 51 to select the pattern mode that the pattern to be sewed belongs to, and the mode selecting interface 411 as shown in FIG. 5 will be displayed on the display 41 of the control unit 40 and comprises: a mode area A, a presser foot area B, a sewing width area C, a stitch length area D, a pattern area E and a thread pressure area F.

The mode area A shows the present mode, and to change the mode, the user can press the pattern mode selecting button 51 again.

The presser foot area B shows the type of the proposed pressure foot B1 and the proposed pressure value B2.

The sewing width area C shows the value of sewing width.

The stitch length area D shows the value of stitch length.

The pattern area E shows the currently selected pattern E1 and its corresponding pattern number E2.

The thread pressure area F shows the pressure of the sewing thread.

Figure 6:
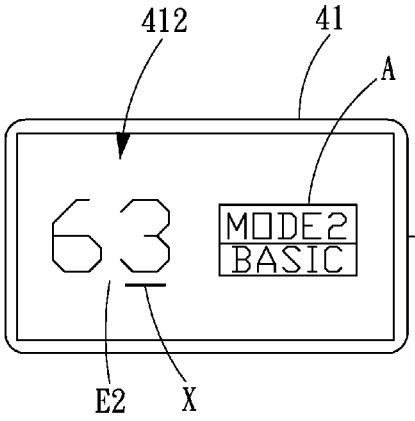
FIG. 6 shows that the step of submode selecting is displayed on the display of the present invention.

Selecting submode 712: selecting the pattern number E2 of the pattern E1 to be sewed, after the step of selecting the mode 711 is finished, the menu on the display 41 will be a sewing pattern selecting interface 412 as shown in FIG. 6, which shows the mode area A and the pattern number E2 of the pattern E1, and the user can move the cursor X to change the pattern E1 to be sewed by changing the pattern number E2.

Figure 7:
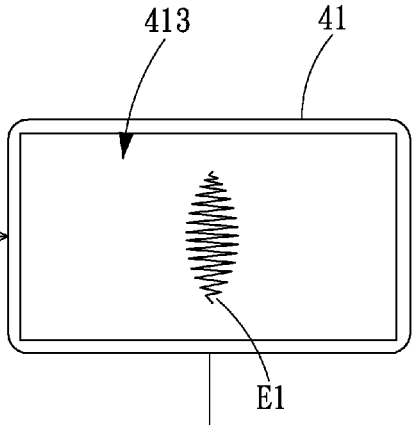
FIG. 7 shows that the step of pattern confirming is displayed on the display of the present invention.

Confirming selected pattern 713: the display 41 of the control unit 40 shows the pattern E1 corresponding to the pattern number E2 inputted by the user, as shown in FIG. 7, a sewing pattern displaying interface 413 is displayed, if the pattern E1 is confirmed, the user should press the input button.

Figure 10:
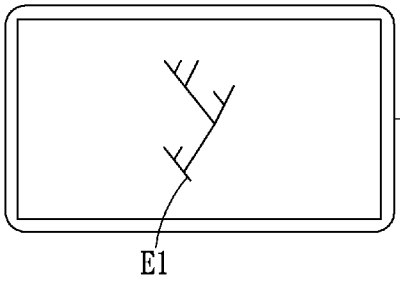
FIG. 10 shows a pattern before mirroring step in accordance with the present invention.
Figure 11:
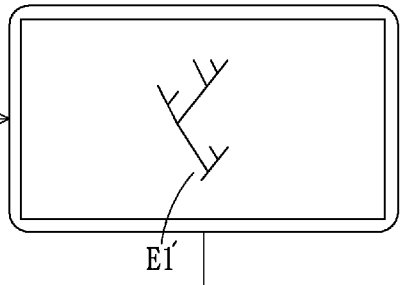
FIG. 11 shows a mirrored pattern in accordance with the present invention.

Mirroring 714: while the pattern E1 is being displayed on the display 41 to wait for the user's confirmation, as shown in FIG. 10, if the user presses the mirror and automatic stop button 52, a post-mirror pattern E1' (means the pattern after being mirrored) will be displayed on the display 41 for the user to confirm, as shown in FIG. 11.

Figure 8:
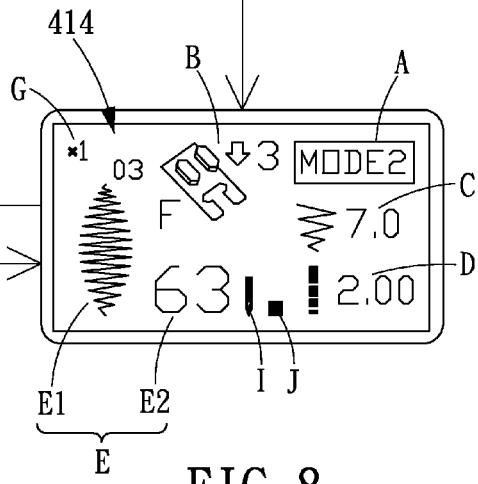
FIG. 8 shows that the information of the patter is displayed on the display of the present invention.
Figure 12:
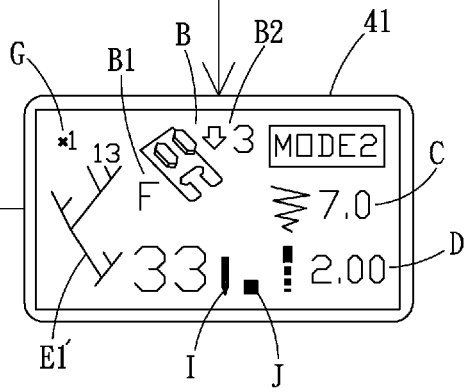
FIG. 12 shows that the mirrored (post mirror) pattern and information of the mirrored pattern are displayed on the displayed of the present invention.

Pattern information setting 715: after the pattern E1 is confirmed, a menu as shown in FIG. 8 for showing standard proposed information of the pattern E1 will be displayed on the display 41, including a mode area A, a presser foot area B, a sewing width area C, a stitch length area D, a times of extension area G, a number of repeat area H, a pattern area E, a single/double needle area I, and an automatic stop area J. after the step of mirroring 714, the pattern area E will display the post-mirror pattern E1', as shown in FIG. 12.

Figure 9:
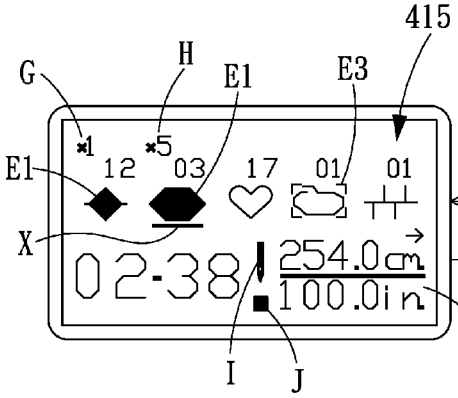
FIG. 9 shows that the pattern string is displayed on the display of the present invention.
Figure 13:
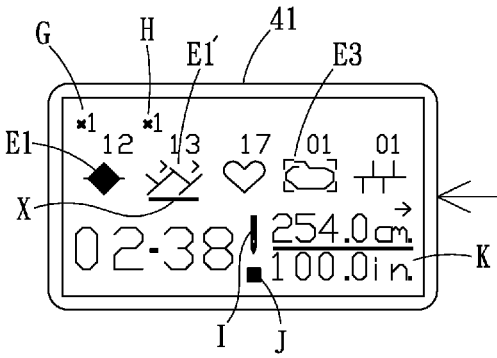
FIG. 13 shows that the mirrored (post mirror) pattern in accordance with the present invention is displayed in the pattern string.

After the user's confirmation, the pattern string editing displaying interface 415 as shown in FIG. 9 will be displayed to show the selected pattern E1, the times of extension area G, the number of repeat area H, the pattern area E, the single/double needle area I, the automatic stop area J, and a total length of the string of to be sewed patterns area K. If want to add a pattern string, the user can press the digit number buttons 631. After confirmation, the pattern string will be added at the position wherein the cursor X is located. If want to further edit the information settings and conditions of the pattern to be sewed, the user can move the cursor X to the pattern E1 and press the input and enter button 65 to enter the single sewing pattern environment displaying interface 414, and then confirms the conditions and information settings displayed, if want to further adjust, the user can re-press the input and enter button 65 to enter the database, so that, at the bottom of the display, the user can press the pattern-extension and memory reading button 54, the digit number button 631, the width adjustment buttons 61 or the input and enter button 65 to adjust the value of settings. Then the user can press the ON/OFF button 14 to perform the sewing operation or press the input and enter button 65 to return to the pattern string editing displaying interface 415 to continue to edit the pattern string, and then can press the ON/OFF button 14 again to start sewing. In this menu, the user can press the digit number button which represents "no sewing" to make the pattern become a frame-selected pattern E3, and the frame-selected pattern E3 won't be sewed. After the mirroring step 714, the display 41 will show the post-mirror pattern E1', as shown in FIG. 13.

The menu (screen) for editing the value of settings shows the same information as that shown in FIG. 8 for the user to edit.

Step of repeating pattern selecting 72: when several pattern strings are to be sewed, the user can repeat the step of pattern selecting 71 and insert the selected pattern in the patter string displayed on FIG. 10.

Cross mode selecting 721: if want to select the patterns of different modes during the step of repeating pattern selecting 72, a long press of the pattern mode selecting button 51 can enable the cross mode editing.

Figure 14:
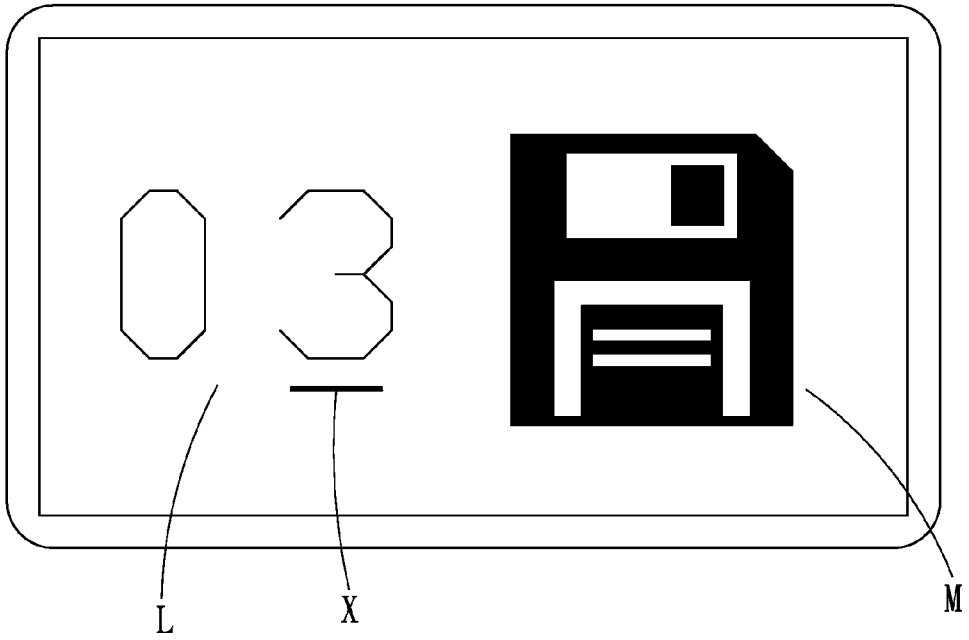
FIG. 14 shows that the step of pattern saving is displayed on the display of the present invention.
Figure 15:
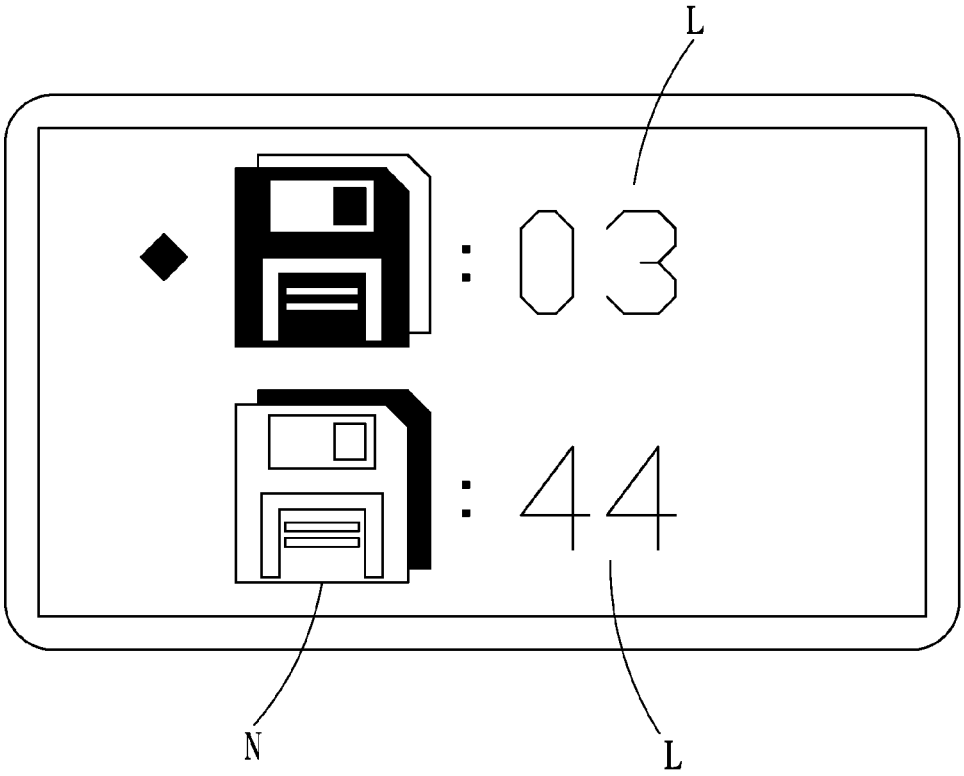
FIG. 15 shows that the step of pattern saving is displayed on the display of the present invention.
Figure 16:
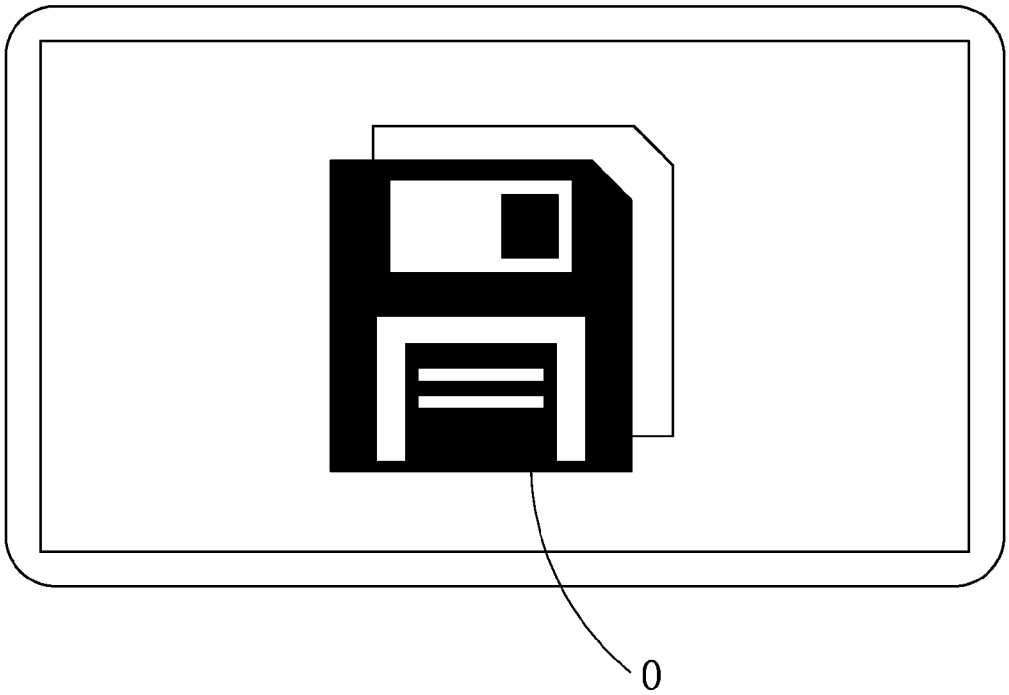
FIG. 16 is another illustrative view showing the step of pattern saving.

Step of pattern saving 73: when the user confirms the selected pattern E1 and presses the memory and whipstitch button 53, a file number area L and a file saving prompt area M will be displayed on the display 41, as shown in FIG. 14. The user can input numbers 01-99 to save the edited pattern strings in the numbered files. Pressing the input and enter button 65 can save the edited pattern strings directly in the file which is being displayed. When a pattern string is edited and then is to be saved, in addition to the abovementioned file number area L and the file saving prompt area M, a "save as" prompt area N and another file number area L will also be displayed, and the file number displayed in the another file number area L for the "save as" prompt area N is one plus the latest file number, as shown in FIG. 15. If the inputs a file number which repeats the existing file numbers that have been saved, an existing file prompt area O will be displayed, as shown in FIG. 16, and then a menu same as shown in FIG. 15 will be displayed for the user to confirm whether to replace the existing file or save with another file number, or not to save by pressing the delete and exit button 64.

Figure 17:
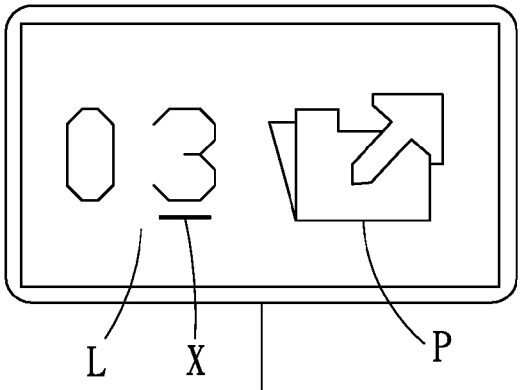
FIG. 17 is an illustrative view in accordance with the present invention showing the step of pattern reading.
Figure 18:
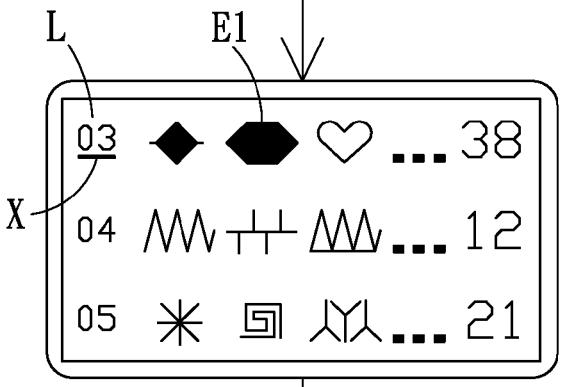
FIG. 18 is another illustrative view in accordance with the present invention showing the step of pattern reading.
Figure 19:
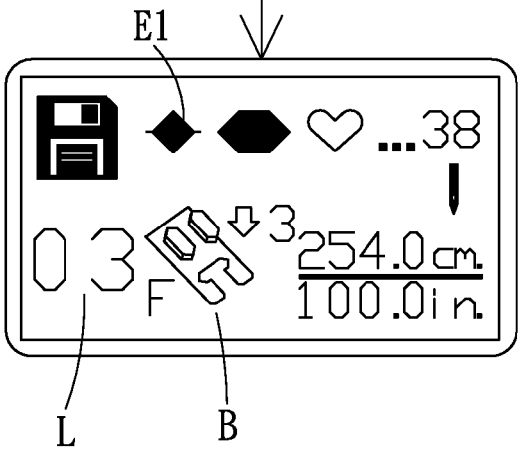
FIG. 19 is another illustrative view in accordance with the present invention showing the step of pattern reading.

Reading pattern 731: after editing and saving the pattern string, the user can select the saved pattern string to perform sewing, and when the user presses the pattern-extension and memory reading button 54, the display 41 will show a reading file prompt area P and a file number area L, as shown in FIG. 17, so that the user can input file number to take out the corresponding pattern string. Or the user can press the input and enter button 65, instead of inputting a file number, to enter the pattern string table, and then moves the cursor X to change the number displayed in the file number area L to access the saved pattern string. When the input and enter button 65 is pressed, the file number area L and the corresponding pattern E1 saved in the database 21 will be displayed on the display 41 for the user to choose, as shown in FIG. 18. Sewing can be performed directly after selection of pattern. Of course, after selecting the pattern, the user also can press the input and enter button 65 to enter the editing menu, as shown in FIG. 19, and the editing menu will show the file number area L, the pattern E1 of the pattern string, the presser foot area B, the sing/double needle area I and the total length of the string of to be sewed patterns area K.

Step of sewing 74: after selecting the pattern, the user can press the ON/OFF button 14 on the sewing machine 10 to start sewing.

Figure 20:
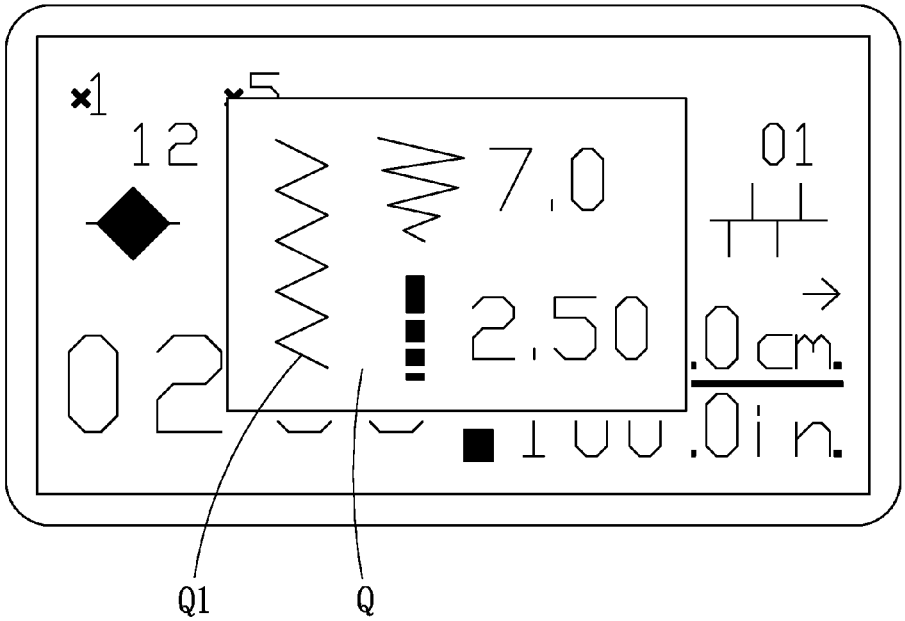
FIG. 20 is illustrative view in accordance with the present invention showing the step of inserting.

Step of inserting 75: in the process of sewing, pressing the Shift and help button 58 and the quick and digit buttons 63 can display a menu same as shown in FIG. 20 on the display 41, in which, the information of the pattern string which is being sewed is displayed and covered with an inserted pattern area Q. The inserted pattern area Q shows the selected quick pattern Q1, at this moment, sewing can be performed. When the sewing is done, pressing the delete and exit button 64 can switch back to the default editing state to go on editing or sewing.

Step of automatic whipstitching 76: when the whipstitch button 13 on the sewing machine 10 is pressed when sewing a specific pattern, it will automatically sew three stitches at the previous needle position, and sewing end, which is suitable for use at the beginning or middle point of the sewing where needs to be strengthened. In case of sewing other patterns, the three stitches are sewed at the end of the sewing (after the sewing is finished) and the sewing ends.

Step of sewing ending 77: pressing the ON/OFF button 14 to stop the sewing.

While we have shown and described various embodiments in accordance with the present invention, it is clear to those skilled in the art that further embodiments may be made without departing from the scope of the present invention.

What is claimed is:

1. A device for controlling sewing patterns of a sewing machine comprising:

the sewing machine electrically connected to a power source and provided on its lateral surface with an ON/OFF button;

a control center disposed inside the sewing machine and provided with a database and being connected to the ON/OFF button, pressing the ON/OFF button sends an instruction to the control center to stop or start sewing;

a control unit electrically connected to the control center and disposed on an outer surface of the sewing machine, the control unit including a display and an input device which are electrically connected to the control center, the input device including a plurality of buttons;

the display including:

a sewing pattern selecting interface being provided with pattern modes and pattern numbers corresponding to the pattern modes for the user to select patterns;

a sewing pattern displaying interface used to display patterns corresponding to the pattern numbers selected by a user;

a single sewing pattern environment displaying interface used to display respective external conditions corresponding to the patterns selected by the user;

a pattern string editing displaying interface used to display a string of several patterns and respective conditions and information of the several patterns;

pressing the buttons to switch among the respective interfaces;

in the database of the control center being saved a plurality of pattern modes and respective conditions corresponding to the pattern mode;

wherein the input device comprises a function selecting area and a quick operation area, the function selecting area includes at least one pattern mode selecting button and a lamp disposed above the pattern mode selecting button, when the pattern mode selecting button is actuated, it will send instruction to the control center, a mode area and a pattern area will be displayed in the respective interfaces to show the pattern and the pattern number, a short press of the pattern mode selecting button performs a single pattern editing and sewing, and a long press of the pattern mode selecting button performs a string of patterns editing, at this moment, the lamp lights up, and a re-press of the pattern mode selecting button brings back the single pattern sewing, and the lamp lights out, so that the user is able to select the pattern mode that the pattern to be sewed belongs to, and to edit a single pattern mode or pattern string that is saved in the database of the control center;

the quick operation area includes a set of quick and digit buttons, the quick and digit buttons include a plurality of digit number buttons, after the pattern mode selecting button is pressed, the user input pattern number by pressing the digit number buttons in the sewing pattern selecting interface, so that corresponding patterns will be shown in the sewing pattern selecting interface for the user to select, a plurality of quick patterns is disposed beside the respective digit number buttons, so that pressing the digit number button is pressed, the sewing of a corresponding quick pattern will be performed.

2. The device for controlling sewing patterns of a sewing machine as claimed in claim 1, wherein the sewing machine is provided on its lateral surface with a whipstitch button electrically connected to the control center, when the whipstitch button is actuated, it will send instruction to the control center, and under the control of the control center, whipstitching will be performed after sewing pattern is finished.

3. The device for controlling sewing patterns of a sewing machine as claimed in claim 1, wherein the pattern modes include a first pattern mode, a second pattern mode, a third pattern mode, a fourth pattern mode and a fifth pattern mode, the first pattern mode includes a plurality of standard patterns, the second pattern mode includes a plurality of basic patterns, the third pattern mode includes a plurality of animals and plants, the fourth pattern mode includes a plurality of other patterns, and the fifth pattern mode includes a plurality of patterns of digital numbers.

4. The device for controlling sewing patterns of a sewing machine as claimed in claim 1, wherein the function selecting area includes a mirror and automatic stop button, when a cursor is moved to a pattern in a pattern string editing displaying interface, a short press of the mirror and automatic stop button can send instruction to the control center, and then the pattern will be mirrored under the control of the control center, a long press of the mirror and automatic stop button sends instruction to the control center, to allow the user to insert a stop element at a position where the sewing needs to stop, so that the control center will control the sewing to stop at the position where the stop element is inserted, so as to stop sewing, and a re-press of the ON/OFF button allows the sewing to start again, a short press of the mirror and automatic stop button before inputting pattern can mirror all the patterns to be input in the future, and a long press of the mirror and automatic stop button before inputting pattern can pre-input the sewing length as desired and prompt when editing.

5. The device for controlling sewing patterns of a sewing machine as claimed in claim 4, wherein when the mirror and automatic stop button is pressed, a post-mirror pattern will be displayed on the display for the user to confirm.

6. The device for controlling sewing patterns of a sewing machine as claimed in claim 1, wherein the function selecting area includes a memory and whipstitch button, a short press of the memory and whipstitch button sends instruction to the control center, and the control center will save edited string of patterns in the database for future use, and a long press of the memory and whipstitch button can send instruction to the control center to perform whipstiching after sewing of pattern string is finished.

7. The device for controlling sewing patterns of a sewing machine as claimed in claim 1, wherein the function selecting area includes a pattern-extension and memory reading button, a short press of the pattern-extension and memory reading button can send instruction to the control center, and the control center will control the pattern extension, and a long press of the pattern-extension and memory reading button can send instruction to the control center, and the control center controls and reads saved string of patterns.

8. The device for controlling sewing patterns of a sewing machine as claimed in claim 1, wherein the function selecting area includes a leftward and upward moving button, pressing the leftward and upward moving button will send instruction to the control center, and then the control center controls the cursor on the display of the control unit to move leftward and upward.

9. The device for controlling sewing patterns of a sewing machine as claimed in claim 1, wherein the function selecting area includes a rightward and downward moving button, pressing the rightward and downward moving button can send instruction to the control center, and then the control center controls the cursor on the display of the control unit 40 to move rightward and downward.

10. The device for controlling sewing patterns of a sewing machine as claimed in claim 1, wherein the function selecting area includes a single/double needle selecting and setting button, a short press of the single/double needle selecting and setting button can send instruction to the control center, and the control center will switch sewing modes between single needle and double needle, and a long press of the single/double needle selecting and setting button can send instruction to the control center, and the control center will start the basic function settings.

11. The device for controlling sewing patterns of a sewing machine as claimed in claim 1, wherein the function selecting area includes a Shift and help button, pressing the Shift and help button can activate Shift "function", and then pressing the button of the quick operation area of the input device of the control unit can start to sew the pattern predetermined by the button of the quick operation area, then pressing the delete and exit button can release the Shift function, a long press of the Shift and help button can send instruction to the control center, and the control center will start explanation mode, a short press of the Shift and help button along with a long press of the mirror and automatic stop button can send out a single-pattern-stop message, so that at each time when the sewing of the each one of the string of the patterns is finished, the sewing will stop automatically, a one more short press of the Shift and help button along with a long press of the mirror and automatic stop button can switch the sewing to normal sewing state, furthermore, a short press of the Shift and help button along with the memory and whipstitch button can perform automatic whipstitching of a single pattern of the pattern string, namely performing the whipstitching of a single pattern of the pattern string prior to the sewing of the same, and the whipstiching should be performed one more time after the sewing is finished, and then one more short press of the Shift and help button along with a long press of the memory and whipstitch button can switch the sewing to normal sewing state.

12. The device for controlling sewing patterns of a sewing machine as claimed in claim 1, wherein the function selecting area includes a set of width adjustment buttons, the width adjustment buttons include an increase button and a decrease button, pressing the increase button can send an instruction to the control center to increase the sewing width, similarly, pressing the decrease button can send an instruction to the control center to reduce the sewing width, and simultaneously pressing the increase and decrease buttons can return the sewing width back to default value.

13. The device for controlling sewing patterns of a sewing machine as claimed in claim 1, wherein the quick operation area includes a set of stitch length buttons, the stitch length buttons include an increase button and a decrease button, pressing the increase button can send an instruction to the control center to increase the stitch length, similarly, pressing the decrease button can send an instruction to the control center to reduce the stitch length, and simultaneously pressing the increase and decrease buttons can return the stitch length back to a default value.

14. The device for controlling sewing patterns of a sewing machine as claimed in claim 1, wherein the quick operation area includes a delete and exit button, a short press of the delete and exit button can make ready to delete an unwanted pattern in the editing of the pattern string, and a long press of the delete and exit button can delete the unwanted pattern, which is accompanied by sending out a long audible warning, and when in the "explanation mode", pressing the delete and exit button can return back to previous menu.

15. The device for controlling sewing patterns of a sewing machine as claimed in claim 1, wherein the quick operation area includes an input and enter button, during the course of editing, pressing the input and enter button can confirm the information displayed on the display so as to be ready to perform the next operation, pressing the pattern number can display the pattern designated by the selected numbers, if confirmed, pressing the input and enter button can input the selected pattern into the pattern string, and when in the "explanation mode", pressing the input and enter button can enter a selected explanation mode.

16. The device for controlling sewing patterns of a sewing machine as claimed in claim 1, wherein anyone of the digit number buttons is able to represent "no sewing" instruction, by pointing this "no sewing" digit number button at a pattern and pressing it, the pattern will not be sewed.

17. The device for controlling sewing patterns of a sewing machine as claimed in claim 16, wherein the "no sewing" instruction is designated by the digit number button "0".

18. A method for controlling sewing patterns of a sewing machine used in cooperation with the device for controlling sewing patterns of a sewing machine as claimed in claim 1, comprising the following steps:

step of pattern selecting including:

a selecting mode: pressing the pattern mode selecting button to select the pattern mode that the pattern to be sewed belongs to, and the mode selecting interface will be displayed on the display of the control unit and comprises: a mode area, a presser foot area, a sewing width area, a stitch length area, a pattern area and a thread pressure area;

the mode area showing the present mode, and to change the mode, a user can press the pattern mode selecting button again;

the presser foot area showing type of the proposed pressure foot and the proposed pressure value;

the sewing width area showing a value of sewing width;

the stitch length area showing a value of stitch length;

the pattern area showing the currently selected pattern and its corresponding pattern number;

the thread pressure area showing a pressure of the sewing thread;

a selecting submode for selecting the pattern to be sewed, the mode selecting interface being displayed on a display to show the mode area and the pattern number of the pattern, and the user can move the cursor to change the pattern by changing the pattern number;

confirming selected pattern: if the pattern is confirmed, the user should press the input and enter button, and if the pattern needs to be changed, the user should input a new pattern number and confirm again;

pattern information displaying: when editing the pattern for the first time, and after the pattern is confirmed for the firs time, a single sewing pattern environment displaying interface for showing standard proposed information of the pattern will be displayed on the display, including a mode area, a presser foot area, a sewing width area, a stitch length area, a times of extension area, a number of repeat area, a pattern area, a single/double needle area, and an automatic stop area, the user can continue to select pattern numbers to form pattern string;

after the user's confirmation, a pattern string editing displaying interface will be displayed to show the selected pattern, the times of extension area, the number of repeat area, the pattern area, the single/double needle area, the automatic stop area, and a total length of the string of to be sewed patterns area, if want to add a pattern string, the user can press the digit number buttons, after confirmation, the pattern string will be added at the position wherein the cursor is located, if want to further edit the information settings and conditions of the pattern to be sewed, the user can move the cursor to the pattern and press the input and enter button to enter the single sewing pattern environment displaying interface, and then confirms the conditions and information settings displayed, if want to further adjust, the user can re-press the input and enter button to enter the database, so that, at the bottom of the display, the user can press the pattern-extension and memory reading button, the digit number button, the width adjustment buttons or the input and enter button to adjust the value of settings, then the user can press the ON/OFF button to perform the sewing operation or press the input and enter button to return to the pattern string editing displaying interface to continue to edit the pattern string, and then can press the ON/OFF button again to start sewing;

step of sewing: after selecting the pattern, the user can press the ON/OFF button on the sewing machine to start sewing;

step of sewing ending: pressing the ON/OFF button to stop the sewing.

19. A method for controlling sewing patterns of a sewing machine used in cooperation with the device for controlling sewing patterns of a sewing machine as claimed in claim 18, a step of mirroring is performed after confirming selected pattern, while the pattern is being displayed on the display to wait for the user's confirmation, if the user presses the mirror and automatic stop button, a post-mirror pattern will be displayed on the display for the user to confirm.

20. A method for controlling sewing patterns of a sewing machine used in cooperation with the device for controlling sewing patterns of a sewing machine as claimed in claim 19, wherein the pattern after the step of mirroring displayed in the step of pattern information setting and in the pattern string editing displaying interface is the post-mirror pattern.

21. A method for controlling sewing patterns of a sewing machine used in cooperation with the device for controlling sewing patterns of a sewing machine as claimed in claim 18, wherein the user can press the digit number button which represents "no sewing" to make the pattern become a frame-selected pattern, and the frame-selected pattern won't be sewed.

22. A method for controlling sewing patterns of a sewing machine used in cooperation with the device for controlling sewing patterns of a sewing machine as claimed in claim 18 further comprises a step of pattern saving: when the user confirms the selected pattern and presses the memory and whipstitch button, a file number area and a file saving prompt area will be displayed on the display, the user can input numbers 01-99 to save the edited pattern strings in the numbered files by pressing the input and enter button, or the user can choose not to save by pressing the delete and exit button.

23. A method for controlling sewing patterns of a sewing machine used in cooperation with the device for controlling sewing patterns of a sewing machine as claimed in claim 18, wherein, in the step of pattern saving, if the inputs a file number which repeats the existing file numbers that have been saved, an existing file prompt area will be displayed, and then a file number area and a "save as" prompt area will be displayed for the user to confirm whether to replace the existing file or save with another file number.

24. A method for controlling sewing patterns of a sewing machine used in cooperation with the device for controlling sewing patterns of a sewing machine as claimed in claim 23 further comprises a step of reading pattern: after editing and saving the pattern string, the user can select the saved pattern string to perform sewing, and when the user presses the pattern-extension and memory reading button, the display will show a reading file prompt area and a file number area, so that the user can input file number to take out the corresponding pattern string, or the user can press the input and enter button, instead of inputting a file number, to enter a pattern string table, and then moves the cursor to change the number displayed in the file number area to access the saved pattern string.

25. A method for controlling sewing patterns of a sewing machine used in cooperation with the device for controlling sewing patterns of a sewing machine as claimed in claim 24 further comprises a step of inserting, by pressing the Shift and help button and the quick and digit buttons, the information of the pattern string which is being sewed and an inserted pattern area will be displayed in the pattern string editing displaying interface, at this moment, quick pattern sewing is allowed be performed, and when the sewing is done, pressing the delete and exit button can switch back to the default editing state.

26. A method for controlling sewing patterns of a sewing machine used in cooperation with the device for controlling sewing patterns of a sewing machine as claimed in claim 18 further comprises a step of automatic whipstitching: when the whipstitch button on the sewing machine is pressed, three stitches will be sewed at the end of the sewing.

* * * * *